US008539673B2

(12) United States Patent
Gügel et al.

(10) Patent No.: US 8,539,673 B2
(45) Date of Patent: Sep. 24, 2013

(54) METHOD AND DEVICE FOR MACHINING A SEALING SEAT OF A SHUT-OFF VALVE

(75) Inventors: Siegfried Gügel, Möhrendorf (DE); Karl-Heinz Herzing, Pegnitz (DE); Josef Sprehe, Fürth (DE); Volker Wurzer, Wesel (DE)

(73) Assignee: Areva GmbH, Erlangen (DE)

( * ) Notice: Subject to any disclaimer, the term of this patent is extended or adjusted under 35 U.S.C. 154(b) by 0 days.

(21) Appl. No.: 13/463,985

(22) Filed: May 4, 2012
(Under 37 CFR 1.47)

(65) Prior Publication Data

US 2012/0240403 A1 Sep. 27, 2012

Related U.S. Application Data

(63) Continuation of application No. PCT/EP2010/066780, filed on Nov. 4, 2010.

(30) Foreign Application Priority Data

Nov. 4, 2009 (DE) ..... 10 2009 046 401

(51) Int. Cl.
*B23P 6/00* (2006.01)

(52) U.S. Cl.
USPC ..... 29/890.121; 29/402.01; 29/402.02; 82/1.2; 82/1.4; 137/242; 137/243; 451/430

(58) Field of Classification Search
USPC ..... 29/890.121, 402.01, 402.02; 82/1.2, 82/1.4, 1.5; 137/242, 243; 451/430
See application file for complete search history.

(56) References Cited

U.S. PATENT DOCUMENTS

| | | | | |
|---|---|---|---|---|
| 4,000,584 | A * | 1/1977 | Uyetake et al. | 451/430 |
| 4,114,323 | A * | 9/1978 | Okano et al. | 451/430 |
| 4,367,766 | A * | 1/1983 | Uomala | 137/243 |
| 5,732,607 | A * | 3/1998 | Strait | 82/1.2 |
| 6,007,410 | A | 12/1999 | Nerenberg | |

FOREIGN PATENT DOCUMENTS

| | | | |
|---|---|---|---|
| DE | 109822 | A1 | 11/1974 |
| DE | 2400077 | A1 | 7/1975 |
| DE | 2508868 | A1 | 9/1975 |
| DE | 3237902 | A1 | 4/1984 |
| DE | 217171 | A1 | 1/1985 |
| DE | 8706117 | U1 | 6/1987 |
| DE | 278542 | A1 | 5/1990 |
| DE | 102005004232 | A1 | 8/2006 |

OTHER PUBLICATIONS

International Search Report, dated Apr. 5, 2011.

* cited by examiner

*Primary Examiner* — Richard Chang
(74) *Attorney, Agent, or Firm* — Laurence A. Greenberg; Werner H. Stemer; Ralph E. Locher

(57) ABSTRACT

A method for machining a sealing seat of a shut-off valve in a power generating or industrial plant. An upper valve part and the internal housing fittings are removed from the housing of the shut-off valve to thereby expose a housing opening. A clamping device with a counter-bearing is introduced through the housing opening into the connection pipe and fastened to its inner wall. A machine tool with a bearing is introduced through the housing opening and mounted with its bearing on the counter-bearing. A machining step is carried out with the machine tool on the sealing seat. Then the machine tool is detached and removed through the housing opening. The clamping device is detached from the connection pipe and removed through the housing opening. Then, the upper valve part and the internal fittings are reattached to the housing.

18 Claims, 6 Drawing Sheets

METHOD AND DEVICE FOR MACHINING A SEALING SEAT OF A SHUT-OFF VALVE

CROSS-REFERENCE TO RELATED APPLICATION

This application is a continuation, under 35 U.S.C. §120, of copending international application PCT/EP2010/066780, filed Nov. 4, 2010, which designated the United States; this application also claims the priority, under 35 U.S.C. §119, of German patent application No. DE 10 2009 046 401.8, filed Nov. 4, 2009; the prior applications are herewith incorporated by reference in their entirety.

BACKGROUND OF THE INVENTION

Field of the Invention

The invention relates to a method and a device for machining a sealing seat of a shut-off valve.

A wide variety of shut-off valves are used for shutting off pipelines in power plants or industrial plants. What may be considered as industrial plants are, for example, all plants, for example of the chemical industry, which operate with fluids. The term power plants as used herein includes all types of power plants, such as, for example, nuclear power plants, including, in particular, boiling and pressurized water reactors.

Relevant shut-off valves are, for example shut-off slides and non-return valves, also referred to as check valves, in the low-pressure (LP), medium-pressure (MP) and high-pressure (HP) range, corresponding approximately to 40 bar, 40-160 bar and above 160 bar. The nominal widths of corresponding shut-off valves are in the range of approximately 50 to 1200 mm.

The shut-off valves have in this case at least two connection pipes which lead into the interior of a valve housing. Such connection pipes with sealing functionality have sealing seats on their end faces. These sealing seats run, for example, parallel to the mid-plane of the shut-off valve (LP non-return valve) or in a plane inclined thereto so as to open toward the valve upper part (HP wedge-type slide).

To close the valves, sealing elements, such as, for example, sealing plates, are moved, for example, via an axial movement of a spindle or a pivoting movement of a non-return valve into the region of the connection pipes of the valve housing and come to bear against the sealing seat. In the case of shut-off slides, for example, the pressure-loaded side (inflow connection pipe) of a shut-off slide presses the sealing plate against the sealing ring or sealing seat on the pressureless side (outflow connection pipe). This gives rise to a sealing-off action. In shut-off valves, for example, the medium is thereby blocked independently of the flow direction, and in non-return valves the media flow is blocked only counter to a stipulated flow direction.

Shut-off slides are usually set in a travel-dependent manner via remote drives or handwheels. The travel dependence of the movement travel means that the sealing plates are moved into and out of the valve housing exactly to an extent such that, even taking into account all thermal expansions, they reliably block or release the sealing seat and do not collide with the valve housing.

Since the sealing surfaces in corresponding shut-off valves have to withstand high load, they are safeguarded or executed, for example in the case of low-pressure valves, up to a nominal pressure (NP) PN40 against wear by means of a 17% chromium steel armoring. In other words a chromium steel layer which is a few millimeters thick is deposited as a hard coating on the end face of the connection pipe.

After a specific number of opening and closing cycles of a shut-off valve under operating conditions, wear behavior occurs at the sealing elements, in particular also the sealing seats, because of the sometimes high surface pressure. The sealing behavior of the shut-off valve decreases with increasing wear of the sealing surfaces, and the leak-tightness of the valves is no longer ensured. Corresponding wear may even commence, depending on the load situation, after one closing cycle or after several thousand closing cycles. This is highly dependent on the nature of the medium flowing through the valve, the temperatures which arise, etc.

It is therefore necessary, in the event of corresponding wear, to renovate the shut-off valve or its seals. This is easily possible with regard to the slide fittings, for example the sealing plates, slides, non-return valves, etc., since these can be removed from the valve housing and renovated outside the valve. Transporting the removed parts usually presents no problem. Renovation can therefore take place, for example, on site in the plant outside the valve, in a site workshop of the plant or at the valve manufacturer's.

The renovation of the sealing seats of the connection pipes presents problems. Access to the sealing seats inside the valve housing is constricted. A method for regrinding the damaged sealing surfaces on site with the aid of what are known as slide grinding machines is known, for example, from German published patent applications DD 217 171 A1, DD 278 542 A1, DE 24 00 077 A1 and DD 109 822 A1. In that case, the valve upper part and the fittings are removed from the housing of the shut-off valve, with the result that a housing orifice is exposed. The grinding machine is introduced through the housing orifice into the valve housing by hand and the existing sealing seat is reground. Material is in this case stripped off in the micrometer range, so that the plane-parallelism of the machined sealing surfaces or housing-fixed sealing seats is restored, in so far as this is possible within the framework of the strip-off range. In spite of the known regrinding, with an increasing service life of the shut-off valves the operationally induced wear and the failure of components and their fittings increase. The constantly recurring regrinding of damage or general wear is possible to only a limited extent, to be precise up to a remaining residual armoring of minimum thickness on the sealing seat. To be precise, with increasing grinding down, the mix-up zone between the basic material and armoring, that is to say the heat influence zone of the welding, is reached, and the required nominal hardness of the armoring is no longer ensured. The wear behavior of the sealing seat therefore increases further in proportion to the number of regrindings or over time, and the failure of the sealing elements or sealing surfaces or sealing seats of the shut-off valves commences.

Since regrinding takes place only in the μm (micron) range and in this case no account is taken of the absolute valve dimensions, for example, one-sided wear of an obliquely fitting sealing seat cannot be corrected, and therefore the sealing seat angle in the valve housing is no longer correct in spite of the reground plane-parallel surface.

If the sealing seats mounted firmly in the housing of the shut-off valve are damaged to an extent such that the above-mentioned regrinding no longer affords a remedy, the damage is eliminated by separating the entire shut-off valve out of the pipeline system. The separated-out valve is then taken for renovation to a site workshop or to the valve manufacturer where there are the necessary renovating machines. The valve is then chucked as a whole, on the outer faces, in a fixture and is renovated by means of conventional machine tools, such as lathes, welding machines, etc.

Alternatively, the defective valve is not renovated, but instead is disposed of, and a new or exchange valve is introduced at the original location of the line system in the power plant or industrial plant. Separating out of a valve and welding one in again entail considerable outlay in terms of cost. Moreover, comprehensive repair specifications are necessary particularly for nuclear power plants. Separating out large and heavy valves from the existing pipe system necessitates special equipment and special lifting appliances and, because of the confined space surrounding the valve, is often possible only after considerable outlay, since, for example, surrounding installation or building parts first have to be removed so that the valve can be separated out at all.

The transport of the valve within a power plant or industrial plant or to the valve manufacturer is complicated and cost-intensive. Particularly in the nuclear power plant sector, the valves are contaminated thus leading to additional outlay and costs. Handling when the valves are being separated out entails an increased risk of injury to the persons involved and the danger that the shut-off valve itself or other components of the industrial plant will be damaged. When the valves are welded in once again, compensating pipes have to be made, since the heat influence zones must be eliminated completely and cutting losses compensated. The installation position of the valve must be restored in the original state. If a new shut-off valve is used, a markedly increased outlay in terms of planning must be expected, since current regulations, such as, for example, the pressurized appliance directive, must be taken into account for the new valve. Increased safety features are then required, as compared with the earlier directives applying to a valve which is usually many years old. Thus, for example, in the case of new shut-off valves, the wall thickness and therefore the weight are increased in relation to an old valve used hitherto. Consequently, it is sometimes necessary to carry out a structurally dynamic calculation of the respective pipeline system or line section, this calculation taking into account the extra weight of the new valve. In the most unfavorable case, holders have to be added or reinforced. A lengthy and cost-intensive building approval procedure is sometimes necessary. Moreover, because of the welding carried out in the pipe system, for example, entire pipe sections which contain the valve have to be subjected to a renewed pressure test.

It is also known from German published patent application DE 10 2005 004 232 A1 to carry out build-up welding on the sealing surface on site. Thus, the upper area of the sealing surface can first be brought to a level which is above the original structural stipulation and is then finally stripped off to the repair level.

SUMMARY OF THE INVENTION

It is accordingly an object of the invention to provide a method and a device for machining a sealing seat of a shut-off valve which overcome the above-mentioned disadvantages of the heretofore-known devices and methods of this general type and which provide for an improved method and an improved device for machining the sealing seat of a shut-off valve that is mounted in a power plant or in an industrial plant.

With the foregoing and other objects in view there is provided, in accordance with the invention, a method of machining a sealing seat, arranged at an end of a connection pipe, of a shut-off valve mounted in a power plant or an industrial plant, the method which comprises the following steps:

removing a valve upper part of the shut-off valve and housing fittings from a housing of the shut-off valve, to thereby expose a housing orifice;

introducing a bracing fixture with a counter-bearing through the housing orifice into the connection pipe or a further connection pipe and fastening the fixture to an inner wall thereof;

introducing a machine tool with a bearing through the housing orifice into the housing and affixing the bearing to the counter-bearing;

machining the sealing seat with the machine tool;

releasing the machine tool from the counter-bearing and removing the machine tool through the housing orifice;

optionally repeating steps c) to e), if required, with a further machine tool or with the same machine tool;

releasing the fixture from the connection pipe and removing the fixture through the housing orifice; and attaching the valve upper part and the fittings to the housing.

The invention is based on the fundamental idea of refurbishing the housing-fixed sealing seats of the shut-off valve on site in the installed state in the line system. The shut-off valve or its valve housing consequently remains mounted in a power plant or industrial plant. By virtue of the corresponding renovating method on site, most of the abovementioned adverse aspects regarding fitting, removal and transport can be avoided.

According to the invention, a complex device is employed for the respective method and is used in the plant for repairing the installed valve. The corresponding sealing seats are accessible only from the housing orifice, to be precise when the valve upper part, drives, sealing plates and other fittings are removed. Since the sealing seats are usually approximately parallel, whereas the housing orifice lies perpendicularly to the mid-plane of the valve, a deflection of force and a deflection of movement through approximately 90° usually have to take place. In the case of wedge-type flat slides, the machining device must additionally be adjustable by the amount of the angle of inclination of the sealing seats with respect to the spindle longitudinal axis, that is to say to said mid-plane. The lack of space in the valve housing necessitates a special type of construction of the machining device, without its functionality being restricted. The machining device must in each case be designed in a flat type of construction, for example so that it can be inserted between two connection pipes or sealing seats of a wedge-type slide. Thus, according to the invention, the machining of the sealing seats can take place from a direction perpendicular to their transverse plane. The corresponding forces for the machining can then be exerted especially simply.

In other words, the novel method includes the following steps:

In a step a), the valve upper part and the fittings are removed from the housing of the shut-off valve, with the result that a housing orifice is exposed. This housing orifice is, for example for valves in the low-pressure and medium-pressure range, a flange and, for valves in the high-pressure range, a housing neck or a housing dome. In a step b), a fixture is introduced through the housing orifice into the connection pipe referred to or a further connection pipe, for example, that lying opposite the sealing seat to be machined. The fixture is fastened to the inner wall of the connection pipe. The fixture has a counter-bearing which in the mounting state, that is to say with the fixture fastened, lies on that side of the fixture which faces the housing interior, and therefore continues to be accessible from the housing orifice.

In a step c), a machine tool is introduced from the housing orifice into the housing. The machine tool carries a bearing, by means of which it is mounted on the counter-bearing. In a step d), a machining step is carried out on the sealing seat by means of the machine tool. Then, in a step e), the machine tool is released from the counter-bearing and is removed through the housing orifice. In the step f), if required, steps c) to e) are repeated by another or the same machine tool.

After the actual work on the sealing seat is terminated, in a step g) the fixture is released from the connection pipe and is removed from the shut-off valve again through the housing orifice. In a step h), finally, the valve upper part and the fittings are attached to the housing again and the valve is thereby completed so as to be ready for operation again.

According to the invention, therefore, by means of the fixture or its counter-bearing and the bearing mounted on the machine tool, it is possible to bring the machine tool into a defined position within the valve housing and to carry out highly accurate work on the sealing seat from there in a directed manner. The fixture and the counter-bearing thus constitute a geometrically exactly fixed and stationary reference location in the valve which remains fixed in place for all the machining steps and their accuracy. The counter-bearing consequently forms a reference point or reference dimension within the valve. This is then fixed in relation to the zero dimension of a valve, for example a flange of a low-pressure slide, and can itself be used in turn as a zero dimension during restoration. In particular, work steps carried out in succession can be carried out, for example by different machine tools in positions exactly building up geometrically one on the other, since all the machine tools are always mounted in the defined geometric position on the counter-bearing which is fixed once and is not moved during the procedure. The fixture is therefore brought, for example, to any desired, but fixed position, and the position of the counter-bearing is then determined in the coordinate system of the valve. Machining then takes place by means of the machine tools, accurately to size, from the position once fixed.

It has been known hitherto to exchange a machining head or tool of a machine. The main body of the machine, for example its drive and the housing, remains as it is. For example, various turning, drilling or milling heads are changed. According to the invention, however, the entire machine tool is changed. This affords the advantage that each machine can be configured in itself and also, for example, with regard to the drive motor, housing, etc., individually and optimally for each of the individual machining steps. However, the geometric reference position which is determined by the counter-bearing then applies to all the machine tools, however differently they are configured.

Since the counter-bearing is fixed in the region of the sealing seat to be machined, the distances to the work region are short. The machine tools used can be of stable and simple design, thus allowing high machining forces.

The sealing plates or slide fittings can be repaired in the usual way, as hitherto, outside the valve housing, for example, in a site workshop.

The method is for example, qualified beforehand on corresponding dummies of the valves, so that reproducibility on the valve to be machined in the plant is ensured. In other words, stimulation is carried out on a sample, for example also in order to complete testing or licensing procedures.

In a preferred embodiment of the method, as a machining step, that end face of the connection pipe which points toward the housing interior is lathe-turned down or ground down. By means of such a work step, it is possible, for example, to lathe-turn down or grind down a fit for a newly to be inserted slide seat ring in an exactly defined geometric plane, to strip off armoring of a sealing seat down to the basic material in a defined plane, or to grind precisely a newly applied armoring both plane-parallel and in a defined plane with respect to the valve geometry. Mechanical final machining of the sealing surfaces can be carried out by lathe-turning and the fine machining of these can be carried out by shaping grinding. Stripping off to the basic material ensures subsequent good cross-linking of material newly to be applied with the basic material of the valve or connection pipe.

In a further preferred embodiment of the method, as a machining step, an armoring forming the sealing seat is welded onto the end face of the connection pipe. Particularly in a combination of this machining step with the abovementioned step, the following procedure is possible: in the case of a valve can be renovated, after the demounting of the slide fittings the initially still present or current state of the sealing seat is surveyed visually or mechanically. For example, the thickness of the remaining armoring still present on the connection pipe is measured. Subsequently, the fixture is mounted, as described, and is fixed in the desired position with respect to the valve geometry, so that, for example, the counter-bearing forms a fixed point at a defined location in the valve. Subsequently, by means of a machine tool, the sealing seat of the opposite connection pipe is lathe-turned down to the basic material, and then, by means of a welding machine or welding device as a machine tool, a new armoring in the original production dimension of the sealing seat is applied. Subsequently, once again, the sealing seat is lathe-turned down to the original production dimension by means of the lathe and is finally fine-ground plane-parallel by means of a grinding machine. The exact original sealing surface geometry is thus restored in the original state, also in respect of the exact geometric position in the valve.

By means of the method according to the invention, therefore, a newly introduced and therefore high-quality hardness profile in the form of a new armoring or new sealing seat can be introduced into the existing shut-off valve. In this case, for example, hardnesses of 340-400 HV (Vickers' hardness) are possible. By means of this method, the service lives and wear behavior are markedly improved on account of the newly introduced hardnesses on the sealing surfaces. Changes are therefore carried out neither on the slide itself nor on the pipe system in which the slide remains permanently installed. The specification of the valve is not changed, since the original state at the time when the valve was produced is restored virtually identically. The preparation of preliminary test documents is appreciably simplified. For example, in a nuclear power plant, only repair preliminary test documents have to be prepared. The entire outlay for removing and fitting the valve by welding is dispensed with, and the plant is not modified, does not have to be hydrostatically tested again, and requires no new operating test or static or dynamic calculations. The disposal problem is markedly minimized, since, for example, an old valve housing, contaminated by radiation, does not have to be disposed of.

The machine tool should in this case have degrees of freedom of five axes, to be precise displacement in the longitudinal direction of the connection pipe, tilting toward the sealing seat, in order to follow various angles of wedge-type slides, rotation about the longitudinal axis and displacement perpendicularly to the longitudinal axis (movement in one plane: 2 degrees of freedom). Any sealing seats can consequently be machined.

In an alternative method variant, as a machining step, a housing seat ring carrying the sealing seat is separated from the connection pipe or is welded to the latter. By means of such a machining step, even high-pressure valves in which the sealing seat itself cannot be renovated on site can be restored. To be precise, the sealing seat is applied as a multilayer ply of special hardness to a corresponding seat ring. For this purpose, it is necessary to have a special workshop which, for example, makes it possible to mount the seat ring horizontally. As a result of the machining step, however, the seat ring is released from the valve. This seat ring on its own can be brought at considerably lower outlay to a special workshop and renovated there. After restoration, it is introduced into the original valve again. Alternatively, a new seat ring is immediately integrated into the valve. The remaining valve stays in the plant and does not have to be exchanged. Even here, as a rule, approval procedures or other additional outlay are markedly reduced.

In such a machining step, as a rule, the fixture is introduced into the same connection pipe which is also to be machined. The fixture is therefore, for example, introduced further into the connection pipe than when the sealing seat lying opposite the connection pipe is to be restored in a low-pressure valve. The fixture is nevertheless again situated as near as possible to the machining location.

In a further method variant, the fixture is fastened in the connection pipe such that a reference point of the fixture lies on the longitudinal mid-axis of the connection pipe. As a result, the geometrically exact or predefined position, referred to above, of the fixture or of the counter-bearing in the coordinate system of the valve is achieved. In a mounted state of the machine tool, when this is held in the counter-bearing, the machine tool is always positioned in the valve geometry at a known position.

With the above and other objects in view there is also provided, in accordance with the invention, a device for machining a sealing seat, arranged at an end of a connection pipe, of a shut-off valve mounted in a power plant or an industrial plant, the device comprising:

a fixture configured for introduction through a housing orifice of a housing of the shut-off valve and into the connection pipe or a further connection pipe, the fixture including a counter-bearing and a fastening element for cooperating with an inner wall of the connection pipe; and at least one machine tool configured for introduction through the housing orifice into the housing and for carrying out a machining step on the sealing seat;

the machine tool having a bearing to be mounted in the counter-bearing.

In other words, the device comprises a fixture which can be introduced through a housing orifice of the shut-off valve into the connection pipe to be restored or into a further connection pipe. The fixture has a counter-bearing and contains a fastening element cooperating with the inner wall of the connection pipe, in order to fasten the fixture securely and, for the duration of the abovementioned method, in a stable manner in the connection pipe. The device comprises, moreover, at least one machine tool, capable of being introduced through the housing orifice into the housing, for carrying out a machining step on the sealing seat. The machine tool has a bearing which can be mounted in the counter-bearing. The device according to the invention has already been described, together with its advantages, in connection with the method according to the invention.

In a special refinement of the invention, the fastening element has an hydraulic cylinder movable up against the inner wall of the connection pipe. By way of one such hydraulic cylinder or, in particular, a plurality of such hydraulic cylinders, the fixture can be fastened in the connection pipe especially simply and with high strength. The fixture is in this case usually disk-shaped or cylindrical and in the mounted state is fixed with its transverse plane parallel to a transverse plane of the connection pipe. The hydraulic cylinders can be remote-controlled by means of a hydraulic line leading toward the outside of the shut-off valve. By the selective activation of various hydraulic cylinders, the position of the fixture in a transverse plane with respect to the connection pipe can be varied in a simple way if, in the mounted state, the hydraulic cylinders extend in an approximately radial direction of the connection pipe.

In accordance with a further preferred refinement, the fixture comprises at least two measuring sensors capable of being brought to bear against the inside of the connection pipe. By means of the measuring sensors, the actual position of the fixture in the connection pipe can be determined, and these are combined, in particular, together with controllable hydraulic cylinders to form a self-adjusting system, so that, for example, the fixture is centered automatically in the connection pipe with respect to the longitudinal mid-axis of the latter. In other words, as a result of appropriate regulation, self-adjusting measuring sensors are thus obtained.

In a further embodiment of the invention, the counter-bearing is a fixable quick-action clamping holder. The bearing is then alternatively or additionally a roller head or ball head. By means of the quick-action clamping holder, a machine tool can be fastened with its bearing to the fixture especially quickly and simply. A change to another machine tool is then possible quickly and simply. As a result of fixability, the relative position between the bearing and counter-bearing and therefore between the machine tool and fixture can be fixed. Thus, the machine tool is then also fixed rigidly in the reference system of the valve, for example in order, during a machining step, to maintain a defined initial position for the machine tool or for a tool, such as a lathe chisel, held by it. By virtue of a roller head, the machine tool acquires only a single degree of freedom of movability, to be precise for carrying out a rotational movement about the roller axis. This is especially desirable, for example, when a machine tool is to be set to the wedge angle of a wedge-type slide sealing seat and different angles are to be assumed here. By contrast, a ball head enables the machine tool to be tilted correspondingly about two axes, although fixing in one plane, for example in the axial direction of the connection pipe, is maintained.

In a further preferred embodiment, the counter-bearing is arranged firmly on the fixture and, moreover, is placed on the latter in such a way that it can be centered on the longitudinal mid-axis of the connection pipe by the fixture being adjusted in the connection pipe. In other words, therefore, the fixture can always be adjusted in the connection pipe such that the counter-bearing is centered on the longitudinal mid-axis of the connection pipe. The counter-bearing thus forms a standardized initial point for the respective bearing of a machine tool. The development of the machine tools can therefore always assume, for example, that their bearing is also located on the longitudinal mid-axis of the connection pipe at the time when machining takes place. The machining geometry can thus be set especially simply.

In a further preferred embodiment, the machine tool has a rigid basic carrier which projects out of the housing orifice in the mounted state and which comprises the bearing. A machining head, in turn, is attached firmly to the basic carrier, so that its angle of inclination to the basic carrier does not vary. It follows from a device of this type that a variation in the angle of inclination of the machining head with respect to the sealing seat is brought about solely by tilting the basic carrier in the counter-bearing. This tilt, in turn, can be set from outside the valve housing in a simple way, for example by hand or by means of a gauge or sliding block. In other words, the basic carrier forms a kind of lever which is accessible and operable outside the housing orifice and by means of which the inclination of the machining head with respect to the sealing seat can be varied. This, too, is suitable for setting the desired inclination of the machine tool and therefore of the sealing seat with respect to the shut-off valve in an especially simple way.

In a variant of this embodiment, the machine tool is a lathe or grinding machine with a drive which in the mounted state lies outside the housing. The basic carrier forms a shaft arm which connects the drive to the machining head. The machining head carries a lathe-turning or grinding element rotatable about an axis of rotation, the axis of rotation having a fixed relative position with respect to the shaft arm. A grinding machine or lathe is thus obtained, the working plane of which can be set in the mounted state from outside the valve housing by moving the shaft arm.

The grinding step in the abovementioned method may also take place, for example, by means of a conventional slide-type grinding machine. However, because of the lathe and grinding machine of the device according to the invention, a separate grinding machine is generally no longer necessary in a plant, thus in turn lowering the overall costs for maintenance machines. All the work can be carried out by the device according to the invention.

In a further refinement of this invention variant, the lathe-turning or grinding element, for example a lathe chisel, as a tool can be fed only in the radial and the longitudinal direction with respect to the axis of rotation. The axial and the radial engagement position of the tool in the longitudinal direction of the longitudinal mid-axis of the connection pipe is therefore brought about by the feed. By contrast, the location of the plane of the engagement position is obtained by adjusting the shaft arm.

In a further preferred embodiment, the machine tool is a welding machine or welding plant, in the mounted state its supply unit, for example the voltage supply and the control, lying outside the housing. A basic carrier having the bearing lies inside the housing. A welding material container and a welding head rotatable about an axis of rotation are arranged on the basic carrier. The axis of rotation lies, for example, perpendicularly to the desired plane of the sealing surface or of the longitudinal mid-axis of the connection pipe.

In an especially preferred embodiment, the welding machine is a TIG orbital welding plant or machine. This affords the advantage that the distance between the welding head and workpiece is regulated here by the plant itself. The welding plant therefore has to be exactly centered only with respect to the transverse plane of the sealing seat.

In a further preferred embodiment, the machine tool comprises a mount fastenable to the housing orifice. For example, a carrier plate is fastened to the flange of a low-pressure valve or to the dome of a high-pressure valve, part of the machine tool, for example the basic carrier or shaft arm, being fixable in turn in the carrier plate. Thus, in the mounted state, the entire machine tool is fixed at least against inadvertent release, but mostly also in a defined location in the shut-off valve. Particularly in the case of overhead-mounted shut-off valves, the machine tool is thus held reliably in its mounting or working position.

In a preferred refinement of this variant, in the mounted state of the machine tool the mount makes it possible to vary and fix the position of the machine tool in the bearing. This is expedient, for example, in conjunction with the abovementioned variation in the pitch angle of a sealing seat of a wedge-type slide, for example when fixing in a customary 3° or 7° oblique position of the machine tool or its tool is possible.

Other features which are considered as characteristic for the invention are set forth in the appended claims.

Although the invention is illustrated and described herein as embodied in a method and device for machining a sealing seat of a shut-off valve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
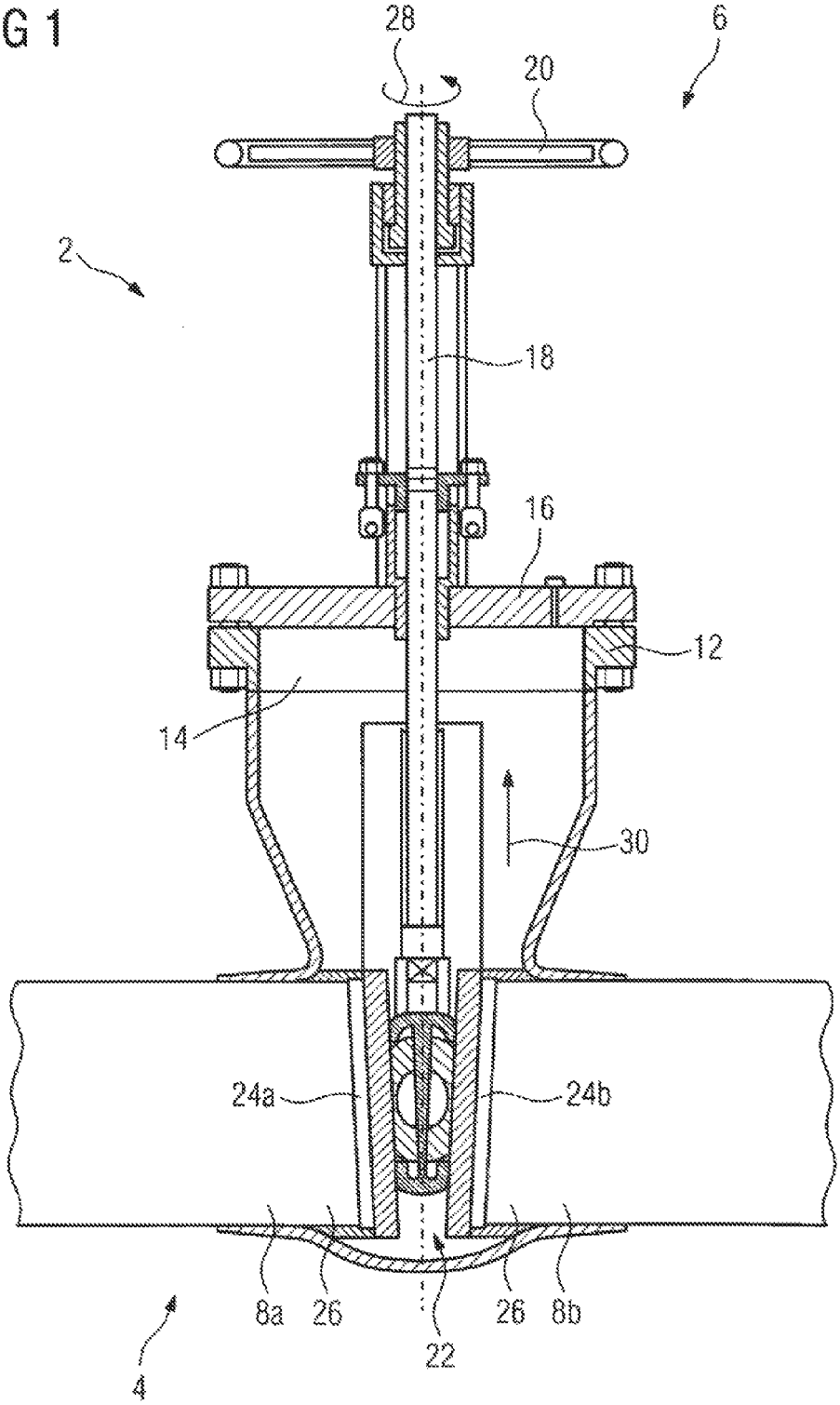
FIG. 1 shows a low-pressure wedge-type slide forming a shut-off valve.

Referring now to the figures of the drawing in detail and first, particularly, to FIG. 1 thereof, there is shown a detail of a pipeline 4 of a plant 2. In the example, we deal with a power plant, as a representative of any power plant or industrial plant. A shut-off valve 6, in the example a low-pressure shut-off slide, is integrated into the pipeline 4. The shut-off valve 6 has as a fixed integral part two connection pipes 8*a, b*, via which it is firmly welded to the pipeline 4. The connection pipes 8*a, b* are part of a housing 10 of the valve 6, which housing has a housing orifice 14 on a flange 12. FIG. 1 shows the shut-off valve 6 in the finally mounted state, to be precise when a housing cover 16 carrying a spindle 18 is mounted on the flange 12. The spindle 18 terminates at one end in a handwheel 20. Located at the other end of the spindle 18 is a sealing element 22 in the form of two sealing plates. The sealing element 22 cooperates with two sealing seats 24*a, b* which are arranged inside the housing 10 on the end faces of the connection pipes 8*a, b*. The sealing seats 24*a, b* are formed in such a way that an armoring 36, in the example made from 17% chromium steel, is welded on the basic material 34 of the connection pipes 8*a, b* at the respective ends 26 on the end faces. The housing cover 16, spindle 18, handwheel 20 and sealing element 22 together form what are known as the housing fittings 32 of the shut-off valve 6 which are all removable from the housing 10.

FIG. 1 shows the shut-off valve 6 in the closed state, that is to say the sealing element 22 bears against the sealing seats 24*a, b*. To open the valve 6, the handwheel 20 is rotated in the direction of the arrow 28, whereupon the spindle 18 lifts off the sealing element 22 from the sealing seats 24*a, b* in the direction of the arrow 30. The ends 26 of the connection pipes

8*a, b* are then completely open and a medium, not illustrated, can flow, unimpeded, through the pipeline 4 in both directions.

The sealing seats 24*a, b* are subject to high wear as a result of the operation of the shut-off valve 6. The shut-off valve 6 has to be renovated in this respect. According to the invention, for this purpose, the shut-off valve 6 remains in the pipeline 4.

Figure 2:
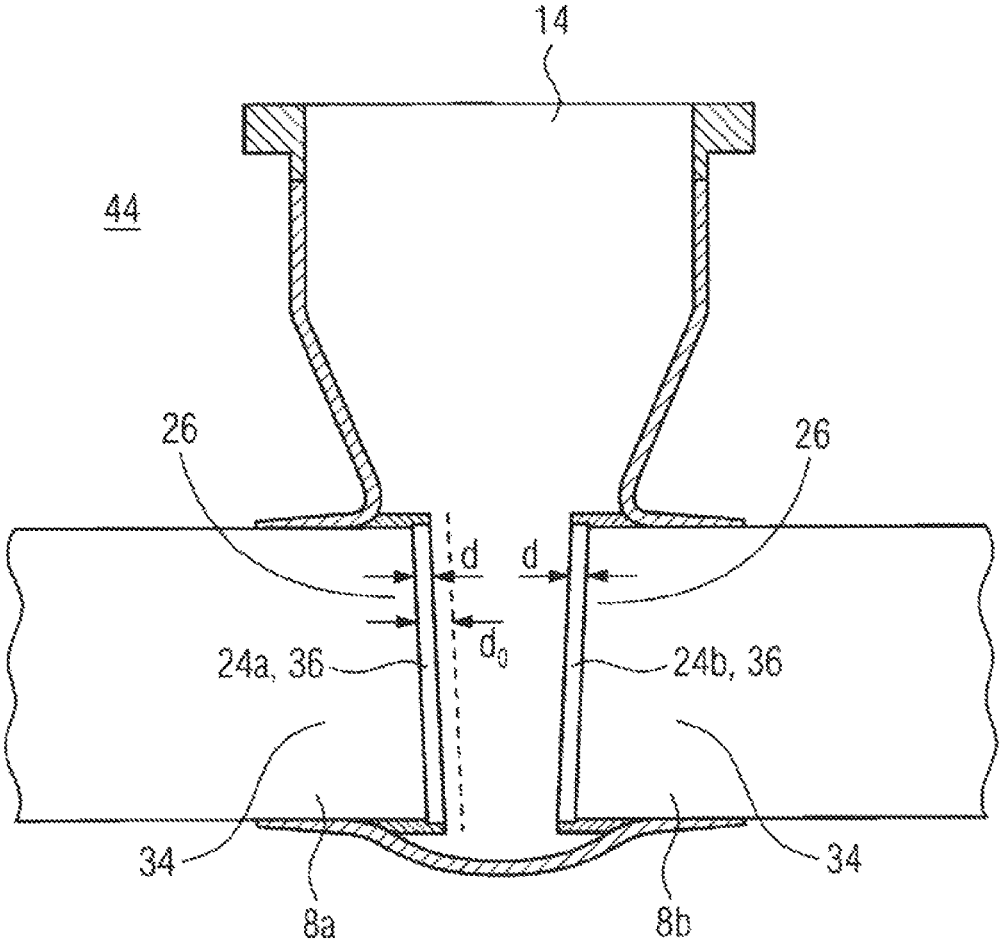
FIG. 2 shows the valve from FIG. 1 in the dismantled state.

In a first method step a), all the housing fittings 32 are first removed. FIG. 2 shows the shut-off valve 6 from FIG. 1 with the housing fittings 32 demounted. The housing orifice 14 is then open, that is to say the interior of the housing 10 is accessible from the outside space 44. Moreover, the sealing seats 24*a, b* can thus be seen through the housing orifice 14 and can be surveyed visually or by means of sliding gauges, not illustrated, or other measuring devices. The current state of the sealing seats 24*a, b* can thus be determined. In particular, for example, it can be established what thickness d the sealing seats 24*a, b* still have. As a result of the operation of the shut-off valve 6, the armoring 36 has been reduced from an original thickness $d_0$, indicated by dashes, at the production time point of the valve 6 to the thickness d.

Figure 3:
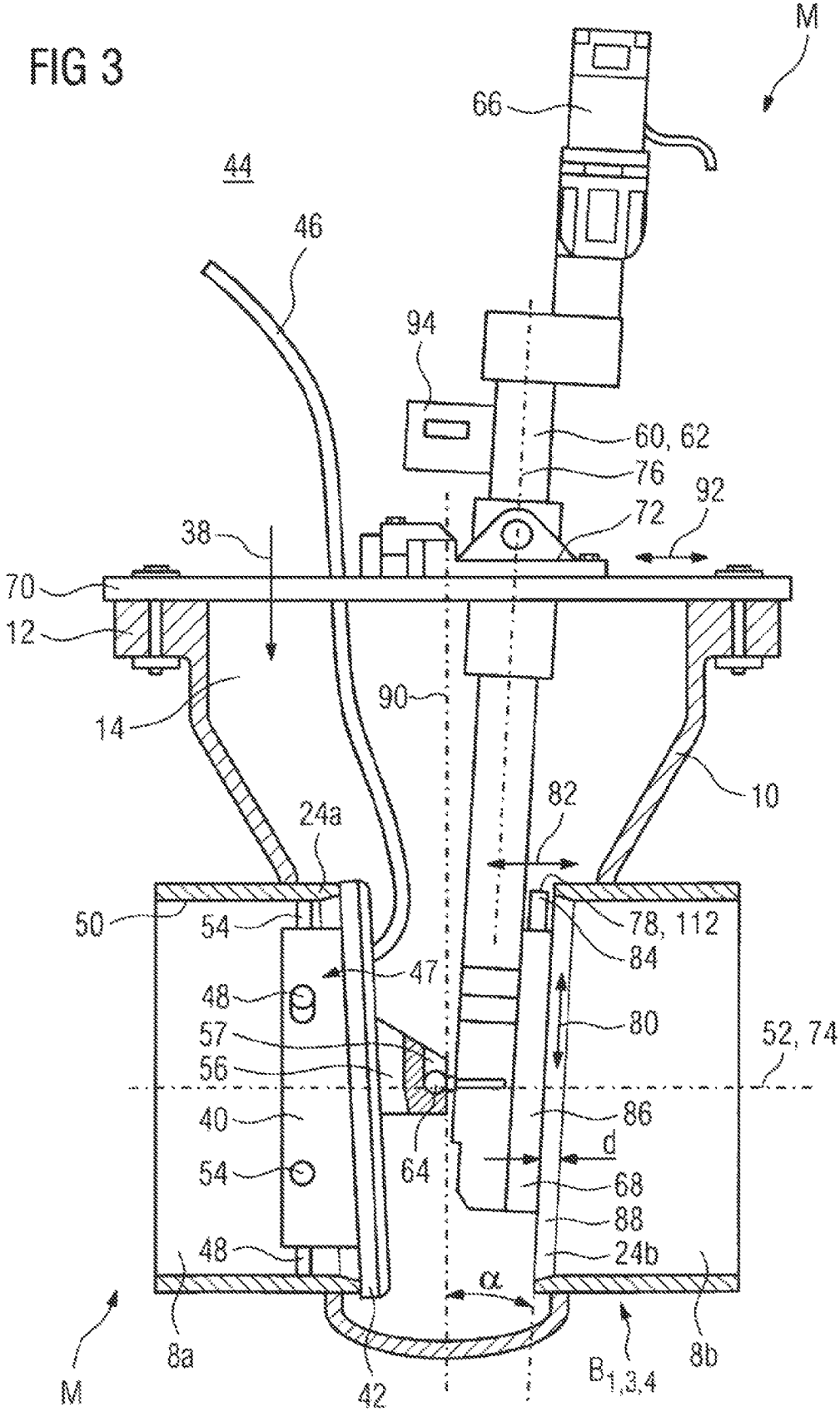
FIG. 3 shows a valve corresponding to FIG. 2 with an inserted fixture and with a lathe and grinding machine.

To renovate the sealing seats 24*a, b*, the following procedure is then also carried out. According to FIG. 3, in a step b), a fixture 40, or a bracing fixture 40, is attached through the housing orifice 14 in the direction of the arrow 38 in the connection pipe 8*a*. The fixture 40 is of approximately disk-shaped design and has an abutment 42 with which it is laid on the sealing seat 24*a*. Via a hydraulic line 46 leading into the outside space 44, hydraulic cylinders 48 attached to the fixture 40 are pressed against the inner wall 50 of the connection pipe 8*a*. The hydraulic cylinder 48 is consequently part of a fastening element, by means of which the fixture 40 is fastened in the connection pipe 8*a*. These are movable essentially radially. The fixture 40 is thereby fixed securely in the connection pipe 8*a*. In order to center the radial position of the fixture 40 in the connection pipe 8*a* exactly on the longitudinal mid-axis 52 of the latter, moreover, the fixture 40 has measuring sensors 54 which point radially outward and by means of which the distance of the fixture 40 to the inner wall 50 can be measured in the respective position of the measuring sensors 54. The hydraulic cylinders 48 are activated correspondingly in order finally to center the fixture 40. FIG. 3 shows the fixture 40 in the finally adjusted mounted state M.

The fixture 40 has a counter-bearing 56 which, in the mounted state M, lies inside the housing 10 or points toward there and which is accessible from the housing orifice 14. Moreover, a reference point 57, to be precise the mid-point of the counter-bearing 56, lies on the longitudinal mid-axis 52. This reference point serves as a fixed geometric initial position for the bearings 64 to be attached, as described below.

In a step c), a machine tool 58 is then introduced in the direction of the arrow 38 likewise through the housing orifice 14 into the housing 10. The machine tool 58 is in FIG. 3 a lathe which has a shaft arm 62 as a basic carrier 60. A bearing 64 matching with the counter-bearing 56 is attached firmly to the basic carrier 60. FIG. 3 shows the machine tool 58 likewise in the mounted state M, to be precise when the bearing 64 is introduced into the counter-bearing 56 or is mounted in this. A drive 66 is attached to that end of the shaft arm 62 which projects out of the housing 10 in the mounted state M, and a machining head 68 is attached to the opposite end of the shaft arm 62. The machining head 68 is rotatable about an axis of rotation 74 which has a fixed angle, in the example a 90° angle, to the longitudinal axis 76 of the shaft arm 62. The machining head 68 has held on it as a machine tool or tool a lathe chisel 78 which can be fed in relation to the shaft arm 62 solely in the radial direction 80 and in the axial direction 82 with respect to the axis of rotation 74. This is achieved by means of a setscrew 84 and a facing slide 86.

The machine tool 58, on the one hand, is fixed or mounted on the housing 10 by means of the bearing 64 via the counter-bearing 56 and the fixture 40 and is in this case pivotable only according to the degree of freedom made possible by the bearing 64 and counter-bearing 56. On the other hand, it is mounted at a further point. To be precise, the flange 12 has screwed to it a mount 70, on which is mounted adjustably, in turn, a carriage 72 which guides the shaft arm 62.

The sealing seat 24*b* must be machined such that its plane 88 assumes a predetermined angle $\alpha$ to the mid-plane 90 of the valve 6, since the shut-off valve 6 is a wedge-type slide. In other words, the machine tool 58 must be pitched correspondingly against the connection pipe 8*b*. Since the axis of rotation 74 is fixed with respect to the longitudinal axis 76, the angle $\alpha$ is set in that the carriage 72 is moved in the direction of the arrow 92, and the shaft arm 62 is thus tilted in the counter-bearing 56. The correct angle $\alpha$ is checked by an inclinometer 94 which is mounted on the shaft arm 62.

In a method step d), a machining step B1 is then carried out on the sealing seat 24*b*. To be precise, by the lathe chisel 78 being fed in the radial direction 80 and the axial direction 82, the armoring 36 still present and having the thickness d is lathe-turned off from the connection pipe 8*b*. The basic material 34 is thus accessible again for stable subsequent welding.

In a step e), the machine tool 58 is then released from the counter-bearing 56 and is removed from the shut-off valve 6 through the housing orifice 14 opposite to the direction of the arrow 38. Since the renovation of the sealing seat 24*b* is not yet concluded, in a step f) the steps c) to e) are then repeated with appropriate frequency using varying machine tools 58.

Figure 4:
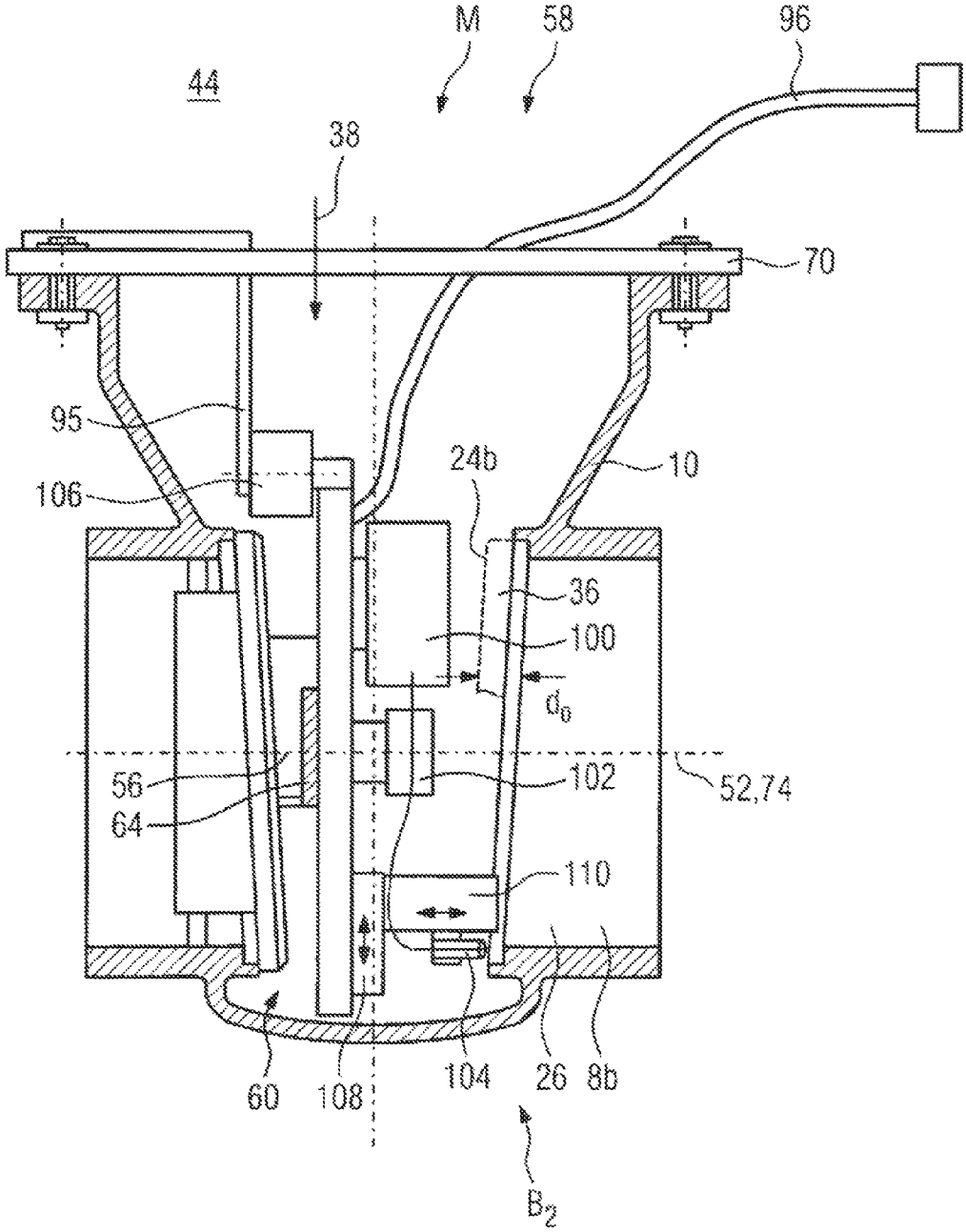
FIG. 4 shows the valve from FIG. 3 with a welding machine.

According to FIG. 4, another machine tool 58 in the form of a TIG orbital welding machine is then introduced in the direction of the arrow 38 through the housing orifice 14 into the housing 10. The machine tool 58 again has on its basic carrier 60 a bearing 64 by means of which it is fastened in the counter-bearing 56. Here too, the basic carrier 60 is again fixed to the mount 70 in order to fix the machine tool 58 in its mounted position M. This takes place via a fixing arm 95. The basic carrier 60 is connected via a supply line 96 to a supply module 98 arranged in the outside space 44. This supply module contains, for example, the power source and the control for the welding appliance. A welding material container 100 in the form of a wire roll, a wire feed 102 and a TIG welding torch 104 are arranged on the basic carrier 60. Via a rotary drive 106, a radial carriage 108 and an axial carriage 110, the TIG welding torch 104 is always held automatically at the correct distance from the object to be welded, to be precise the end 26 of the connection pipe 8*b*.

During the machine step B2 shown in FIG. 4, a new armoring 36 (indicated by dashes) is welded onto the connection pipe 8*b*. The machining step B2 ends when the armoring 36 has reached the original thickness $d_0$ with a specific excess serving for finish-machining. The machine tool 58 is then removed from the housing 10 again opposite to the direction of the arrow 38.

A further method step f) follows. According to FIG. 3, the lathe is used once again as a machine tool 58. The newly applied armoring 36 is lathe-turned off to the original dimension of thickness $d_0$ by means of said machine tool in a machining step B3. The lathe chisel 78 is then replaced as a tool in the machine tool 58 by a polishing tool 112. By means of this, in a final machining step B4, the sealing seat 24*b* is finally machined or polished smooth as the surface of the armoring 36.

Finally, the machine tool 58 is first removed. Since the machining of the sealing seat 24*b* is then concluded, the fixture 40 is also released from the housing 10 and removed subsequently in a method step g).

If appropriate, the fixture 40 is then introduced into the already machined connection pipe 8*b*, and the sealing seat 24*a* is restored to its original dimension of thickness $d_0$ in the way described above.

Figure 5:
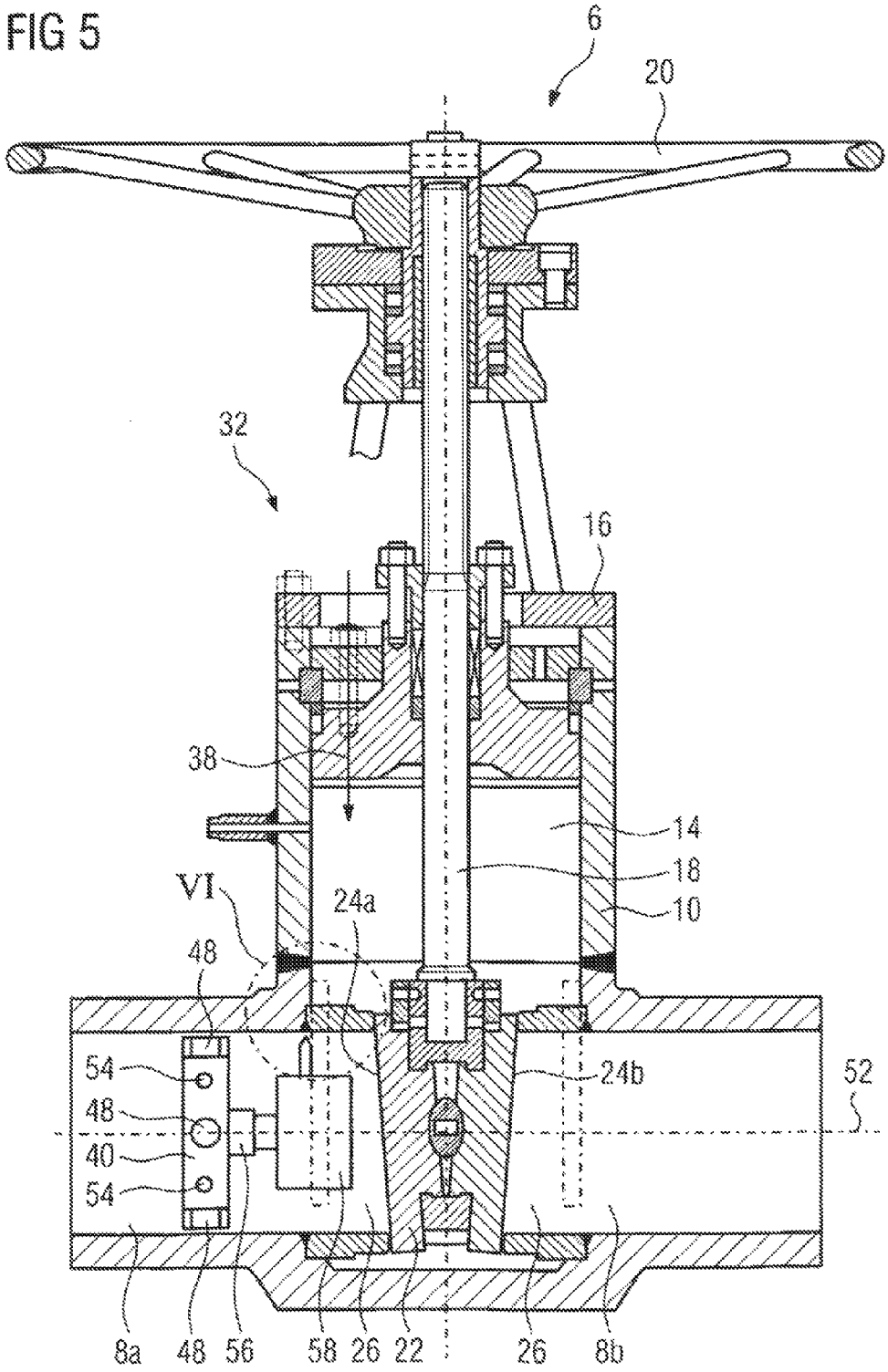
FIG. 5 shows a high-pressure valve with an inserted fixture and lathe.

FIG. 5 shows as an alternative shut-off valve 6 a high-pressure slide which likewise has a housing 10 and connection pipes 8*a, b*, a sealing element 22, a spindle 18, a handwheel 20 and a housing cover 16. In contrast to a low-pressure slide, however, a seat ring 114*a, b* is welded in each case to that end 26 of the connection pipes 8*a, b* which faces the interior of the housing 10. This seat ring carries in each case the sealing seat 24*a, b*.

Restoration again accordingly comprises the same steps as above. In contrast to the above, however, the sealing seats 24*a, b* are not themselves restored on site, but instead are removed, together with their seat rings 114*a, b*, from the valve 6 and restored or exchanged outside. The restored or new seat rings 114*a, b* are then welded in again.

To restore the shut-off valve 6, once again, the entire housing fittings 32 (sealing elements 22, spindle 18, housing cover 16, etc.) are removed, so that a housing orifice 14, through which the interior of the housing 10 is accessible, remains. Correspondingly to the procedure according to FIG. 3, once again, a fixture 40 is introduced completely into the interior of the connection pipe 8*a*, said fixture being equipped correspondingly with hydraulic cylinders 48 and measuring sensors 58 in order to be centered and fixed with respect to the longitudinal mid-axis 52. A machine tool 58 can then be inserted again in the counter-bearing 56. The machine tool 58 is likewise again introduced in the direction of the arrow 38 into the interior of the housing 10 or, in the present case, also into the interior of the connection pipe 8*a*. In contrast to the above, however, the fixture is held in the same connection pipe, the sealing seat of which is also to be restored.

Figure 6:
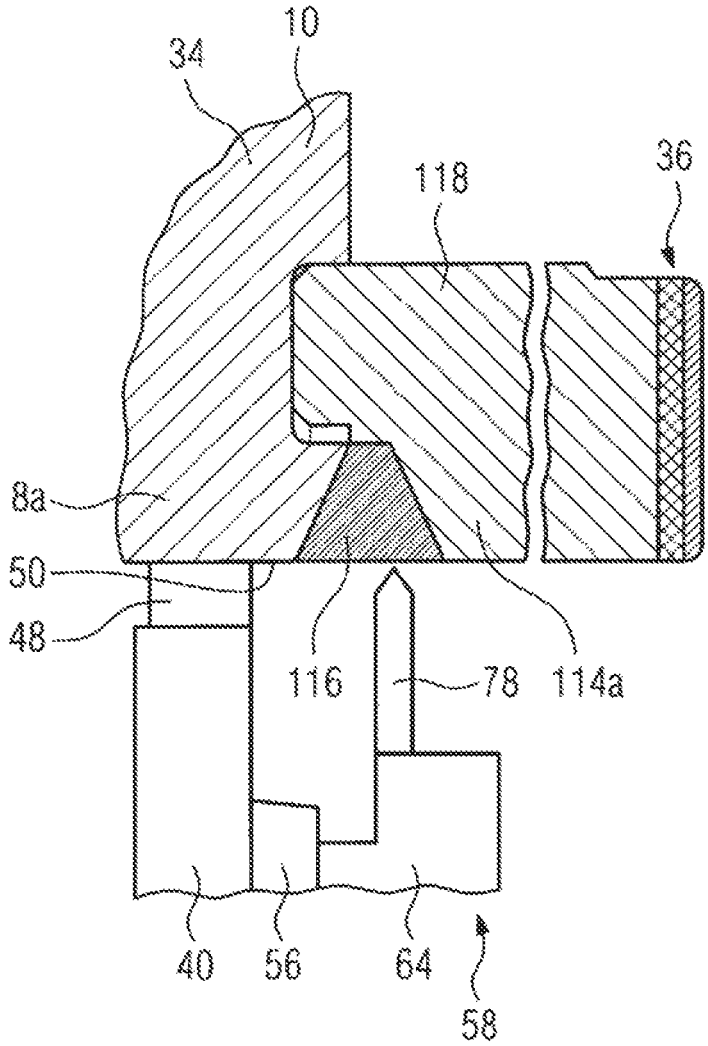
FIG. 6 shows the detail VI from FIG. 5.

FIG. 6 shows the detail VI from FIG. 5. What can be seen is the seat ring 114*a* which is connected via a weld seam 116 to the housing 10 or to the connection pipe 8*a*. The fixture 40 is supported by means of the hydraulic cylinders 48 against the inner wall 50 of the connection pipe 8*a*. The machine tool 58 is held by means of its bearing 64 in the counter-bearing 56. The machine tool 58 is again a lathe with a lathe chisel 78 as a tool which then splits open the weld seam 116. The seat ring 114*a* can then be released and removed through the housing orifice 14. The machine tool 58 is subsequently replaced by a welding unit or machine, not illustrated, in the form of an alternative machine tool 58 which welds in a new seat ring 114*a* or a restored seat ring 114*a* again into the original state shown in FIG. 6. Here too, during all the machining steps, the mount 40 remains permanently braced and thus forms with its counter-bearing 56 a reference position for machine tools 58 to be coupled, in order to coordinate the corresponding machining steps exactly with one another geometrically.

In an alternative embodiment, a degassing slot 118 (indicated by dashes in FIG. 6) is present on the seat ring 114*a* newly to be introduced, in order to discharge welding gas which occurs during machining.

FIG. 6 shows, moreover, how, in the case of a high-pressure sealing seat, this is applied in the form of a multilayer armoring 36 to the seat ring 114*a*, and not directly to the basic material 34 of the housing 10 or connection pipe 8*a*.

The invention claimed is:

1. A method of machining a sealing seat, arranged at an end of a connection pipe, of a shut-off valve mounted in a power plant or an industrial plant, the method which comprises the following steps:

a) removing a valve upper part of the shut-off valve and housing fittings from a housing of the shut-off valve, to thereby expose a housing orifice;

b) introducing a bracing fixture with a counter-bearing through the housing orifice into the connection pipe or a further connection pipe and fastening the fixture to an inner wall thereof;

c) introducing a machine tool with a bearing through the housing orifice into the housing and affixing the bearing to the counter-bearing;

d) machining the sealing seat with the machine tool;

e) releasing the machine tool from the counter-bearing and removing the machine tool through the housing orifice;

f) optionally repeating steps c) to e), if required, with a further machine tool or with the same machine tool;

g) releasing the fixture from the connection pipe and removing the fixture through the housing orifice; and h) attaching the valve upper part and the fittings to the housing.

2. The method according to claim 1, wherein the machining step comprises lathe-turning or grinding down an end face of the connection pipe that points toward an interior of the housing.

3. The method according to claim 1, wherein the machining step comprises welding an armoring forming the sealing seat onto an end face of the connection pipe.

4. The method according to claim 1, wherein the machining step comprises separating a housing seat ring carrying the sealing seat from the connection pipe or welding a housing seat ring to the connection pipe.

5. The method according to claim 1, which comprises introducing the fixture into the connection pipe until the fixture bears with an abutment against that end face of the connection pipe which points toward the interior of the housing.

6. The method according to claim 1, which comprises fastening the fixture in the connection pipe such that a reference point of the fixture lies on a longitudinal mid-axis of the connection pipe.

7. A device for machining a sealing seat, arranged at an end of a connection pipe, of a shut-off valve mounted in a power plant or an industrial plant, the device comprising:

a fixture configured for introduction through a housing orifice of a housing of the shut-off valve into the connection pipe or a further connection pipe, said fixture including a counter-bearing and a fastening element for cooperating with an inner wall of the connection pipe; and at least one machine tool configured for introduction through the housing orifice into the housing and for carrying out a machining step on the sealing seat;

said machine tool having a bearing to be mounted in the counter-bearing.

8. The device according to claim 7, wherein said fastening element comprises an hydraulic cylinder movable up against the inner wall of the connection pipe.

9. The device according to claim 7, wherein said fixture includes at least two measuring sensors capable of being brought to bear against an inside of the connection pipe.

10. The device according to claim 7, wherein said counter-bearing is a fixable quick-action clamping holder and/or the bearing is a roller head or ball head.

11. The device according to claim 7, wherein said counter-bearing is mounted firmly on said fixture such that, when said fixture is adjusted in the connection pipe, said counter-bearing can be centered on a longitudinal mid-axis of the connection pipe.

12. The device according to claim 7, wherein said machine tool comprises a rigid basic carrier projecting in a mounted state out of the housing orifice and carrying said bearing, and a machining head firmly attached to a basic carrier in terms of an inclination thereof relative to the sealing seat, so that a variation in an angle of inclination of the machining head with respect to a mid-plane of the shut-off valve is brought about by tilting said basic carrier in said counter-bearing.

13. The device according to claim 12, wherein said machine tool is a lathe or a grinding machine, with a drive which in the mounted state lies outside the housing, and with a shaft arm extending from the drive to a working head and forming the basic carrier, said machining head having a lathe-turning or grinding element rotatable about an axis of rotation, and the axis of rotation having a fixed relative position with respect to said shaft arm.

14. The device according to claim 13, wherein said lathe-turning or grinding element is mounted for feeding only in a radial direction and an axial direction with respect to the axis of rotation.

15. The device according to claim 7, wherein said machine tool is a welding machine comprises of a supply unit, disposed outside of the housing in a mounted state, a basic carrier inside the housing, and said bearing with a welding material container and a welding head disposed on said bearing and rotatable about an axis of rotation.

16. The device according to claim 15, wherein said welding machine is a TIG orbital welding machine.

17. The device according to claim 7, wherein said machine tool comprises a mount fastenable to the housing orifice.

18. The device according to claim 17, wherein said mount is configured to enable, in the mounted state of said machine tool, varying and fixing a position of said machine tool in the counter-bearing.

* * * * *